US005509876A

United States Patent [19]

Reyes

[11] Patent Number: 5,509,876

[45] Date of Patent: Apr. 23, 1996

[54] WEIGHT-BAR SUPPORT STRUCTURE WITH RETRACTABLE ARMS

[76] Inventor: Gilbert Reyes, 4960 Spanish Heights Dr., Las Vegas, Nev. 89113

[21] Appl. No.: 349,749

[22] Filed: Dec. 2, 1994

[51] Int. Cl.[6] ..... A63B 21/078

[52] U.S. Cl. ..... 482/104

[58] Field of Search ..... 482/94, 97, 104, 482/106, 148; 248/293, 294

[56] References Cited

U.S. PATENT DOCUMENTS

| | | | |
|---|---|---|---|
| 4,602,785 | 7/1986 | Rockwell | 482/104 |
| 4,890,831 | 1/1990 | Craig . | |
| 4,928,961 | 5/1990 | Madden . | |
| 5,151,072 | 9/1992 | Cone et al. . | |
| 5,162,031 | 11/1992 | Watson . | |
| 5,281,193 | 1/1994 | Colbo, Jr. . | |

FOREIGN PATENT DOCUMENTS

| | | |
|---|---|---|
| 3744449 | 7/1989 | Germany . |
| 1443892 | 12/1988 | U.S.S.R. . |

*Primary Examiner*—Richard J. Apley
*Assistant Examiner*—John Mulcahy
*Attorney, Agent, or Firm*—Quirk & Tratos

[57] ABSTRACT

A weight-bar support structure includes a user supporting platform and two spaced apart posts. The first end of a weight-bar supporting arm is connected to a lug extending from each post. A second end of each arm includes a weight-bar supporting cradle and an upwardly extending guide. The arms are moveable from a retracted position to a user lift-off position. A spring having a first end connected to the arm and a second end located in a slot in the lug biases each arm, when a weight laden bar is removed therefrom, from the lift-off to the retracted position.

33 Claims, 5 Drawing Sheets

WEIGHT-BAR SUPPORT STRUCTURE WITH RETRACTABLE ARMS

FIELD OF THE INVENTION

The present invention relates to a weight bench for supporting a weight-laden bar. In particular, the present invention relates to a weight bench having arms for supporting a weight-bar, the arms movable between a retracted position and a lift-off position.

BACKGROUND OF THE INVENTION

Current wisdom, both among the current population and physicians, trainers, and other health care related personnel, is that exercise is beneficial to the health and well-being of individuals. For this reason, more and more individuals are engaging in exercise programs to build muscular strength and improve cardiovascular capacity.

Recently, some fitness experts have declared one or more of the "standby" weight training exercises as undesirable or dangerous. In particular, some have declared these exercises unhealthy, or as creating a risk of injury high enough that they are not recommended to the majority of the population. Unfortunately, no substitute exercise is often available which is as effective as the particular weight-training exercise.

One exercise which has been viewed at times with some negativity is the bench press. In this exercise, a user lays on his back on a bench, and then raises and lowers a weight-laden bar over his chest while grasping the bar with his hands. This exercise can entail the lifting of a considerable amount of weight, often hundreds of pounds. The actual pressing of the weight-laden bar up and down does not pose the most substantial risk of injury during the exercise, however.

To commence a bench press, the bar must be retained in a position away from the bench so the person exercising can move into the correct position on the bench. Once positioned on the bench, the user moves the bar into position and starts the exercise.

Normally, the person exercising lays on a flat bench located between two upwardly extending support posts. The bar, in its resting position, is located on hooks extending outwardly from the posts. The user lays on the bench, reaches upwardly and grasps the bar, and then removes it from the hooks to begin the exercise.

In order that the support posts and hooks not obstruct the area in which the exerciser moves the bar up and down during the exercise, the support posts are located behind the user's shoulders and approximately on either side of the user's head. The location of the posts means that the user must reach backwardly to grasp the bar and lift it off of the posts.

Because the support posts are located behind the lifter's head, his arms are in an awkward position when the bar is lifted from the supports. In this position, the exerciser has reduced strength and control over the weight, and the shoulders are in a position in which they are most susceptible to extreme stress and injury. A lifter otherwise capable of completing the exercise of moving the bar up and down over his chest can injure himself when attempting to lift the bar from the posts.

One method of reducing this risk of injury has been to have a "spotter" aid in lifting the bar from the hooks and positioning the bar over the chest of the exerciser. In addition to the inconvenience of requiring the presence of a second person, this method has two serious drawbacks which can result in injury to both the spotter and the exerciser.

First, the spotter must stand behind the head of the exerciser and lift the bar off of the posts. The spotter reaches forward and lifts the bar from the posts in a maneuver which approximates an upright rowing exercise. The spotter then moves the bar outwardly from his body over the chest of the exerciser. When the spotter lifts the bar from the posts, the spotter is lifting a substantial amount of weight in a weak position. The spotter often suffers shoulder injuries as a result. Secondly, because the exerciser and bench prevent the spotter from moving forward, the spotter must lean over or extend his reach to place the bar over the exerciser's chest. The spotter can suffer back, shoulder, and arm injuries as a result.

Moreover, the exerciser can suffer injuries when a spotter is used. Because the exerciser does not lift all of the weight on the bar from the post, the exerciser does not adjust and stabilize the bar as it is removed from the post. Therefore, when the spotter releases his grip from the bar when it is located over the exerciser, the shift in weight to the exerciser is often so sudden that the exerciser has difficulty in stabilizing the bar. As a result, the exerciser can drop the bar, or injure shoulder or arm muscles attempting to right the bar.

Another risk of injury from the bench press exercise arises if the exerciser is incapable of returning the weight-laden bar to the hooks on the support post. This often occurs when the exerciser is fatigued and unable to press the bar high enough to reach the hooks.

Normally, exercisers also engage a spotter who aids in raising the bar to its resting position if the exerciser encounters these difficulties. As described above, however, because of the position of the spotter and the exerciser, the spotter is not in position in which he can offer substantial leverage to lift the bar from the exerciser, and can injure himself attempting to reach over and lift the bar upwardly.

Other exercises which have substantially the same arrangement whereby the bar is supported in a resting location which is not easily reached by the exerciser for use present many of the same problems and risks of injury. Such exercises include the incline bench press, the decline bench press, and the military bar press.

SUMMARY OF THE INVENTION

In accordance with the present invention a weight-bar support structure having weight-bar supporting arms which are movable between a first retracted weight-bar supporting position and a second weight-bar lift-off position is provided.

The support structure includes a user supporting platform, and two upwardly extending posts located on either side of the platform. A weight-bar supporting arm is connected to a lug extending outwardly from each post.

The arm has a first end portion connected to the lug. Pins pass through a sleeve in outer flange portions on each side of the arm and engage opposite sides of the lug. In this fashion, the arm is rotatably connected to the lug.

A "J"-shaped weight-bar support member is located at a second end portion of the arm. The bottom portion of the "J"-shaped member forms a bar supporting cradle. The top portion of the "J"-shaped member acts as a guide means for directing the bar back into the cradle.

Each arm is moveable from a first retracted position in which the arm extends substantially upwardly along the post, to a weight-bar lift-off position in which the arm extends outwardly over the platform. A cushion is located on the lug for engagement with a bottom edge of the arm for limiting the rotation of the arm at the lift-off position. A stop located on the back of the arm engages another cushion on the lug for limiting the rotation of the arm at the retracted position.

Return or biasing means are provided for automatically moving the arms from the lift-off position to the retracted position when the user removes the weight-bar from the arms. The return means comprises a flat spring having a first end connected to the arm and a second end connected to the lug.

In use, a user places a bar into the cradles of each arm with the arms in the retracted position. The user lays on the platform and moves the bar and arms to the lift-off position. When the user lifts the bar from the cradles, the spring in each arm returns the arm to the retracted position. After the user has completed the exercise, he moves the bar against the guides, and downwardly into the cradles.

Further objects, features, and advantages of the present invention will become apparent from the detailed description of the drawings which follows, when considered with the attached figures.

DETAILED DESCRIPTION OF THE PREFERRED EMBODIMENT

Figure 1:
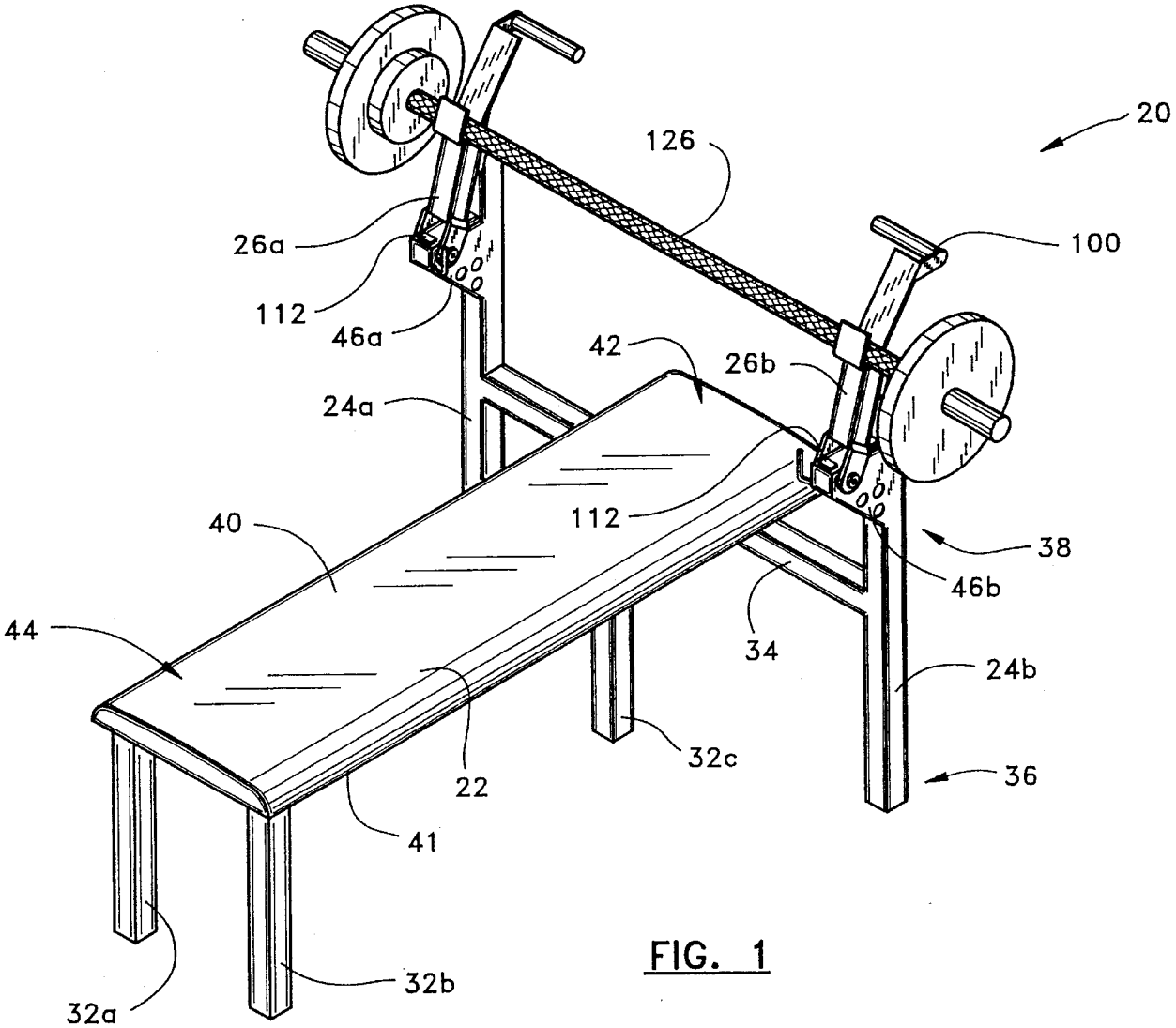
FIG. 1 is a perspective view of a preferred embodiment of the weight-bar supporting structure of the present invention, illustrated with arms thereof in a retracted position.

FIG. 1 illustrates a weight-bar support structure 20 in accordance with the present invention. In general, the structure 20 preferably includes a user supporting platform 22, two upwardly extending posts 24*a,b*, and a weight-bar supporting arm 26*a,b* located on each post. The platform 22 is supported by at least one, and preferably three legs 32*a,b,c*, and a cross-beam 34 extending between the posts 24*a,b*.

Vertical posts 24*a,b* are spaced about 40–50, and most preferably about 45 inches apart. Each post 24*a,b* is about 30–40, and most preferably about 35 inches tall, having a first end portion 36 for contacting the ground, and a second free end portion 38. The posts 24*a,b* are constructed of a rigid strong material such as aluminum or steel. A-36 steel in hollow tubular form about 2 inches square with a wall thickness of about 3/16 of an inch is useful. A flat plate or similar member may be located on the bottom of each post to protect the surface on which the posts rest, and to provided added support to the structure.

The cross-beam 34 is preferably about 45 inches long, and extends between the two posts 24*a,b*. The exact length of the cross-beam 34 is determined by the distance the posts 24*a,b* are set apart, as it connects them.

The cross-beam 34 extends perpendicularly to the vertical posts 24*a,b* about 12–14 inches above the ground. The cross-beam 34 extends between the posts 24*a,b* a distance above the ground approximately equal to the distance above the ground an exerciser is supported when the user is exercising. The exerciser is supported between 12 and 18 inches, and most preferably about 16 inches above the ground during exercise. This distance allows for most users to sit or lay on the platform 22 and have their feet touch the ground. Each leg 32*a,b,c*, described in more detail below, is about 13 inches long, preferably equal in length to the height the cross-beam 34 is located above the ground. Each leg 32*a,b,c* may include a flat foot or similar member for reducing the marring of the surface on which they rest.

As can be seen in FIG. 1, the platform 22 is supported by the legs 32*a,b,c* and the cross-beam 34. The user supporting platform 22 is about 45–50 inches long, 11–12 inches wide, and 3–5 inches thick. The platform 22 is preferably made of wood or metal with a layer of padding located on an upper surface 40 thereof. In particular, a layer of foam or similar padding is located over the base material, with a layer of vinyl, leather or similar durable material located over the padding. The platform 22 also includes a bottom surface 41, and a first end portion 42 and second end portion 44. A central structural support (such as a 2 inch square metal tube, not shown) runs along the length of the bottom surface 41 of the platform 22 and may be connected to the cross-beam 34 and an end support to which the legs 32*a,b* are connected, to provide added support and rigidity.

The first end portion 42 of the platform 22 is preferably located on and supported by the cross-beam 34. The bottom surface 41 of the platform 22 is secured, at the first end portion 42, to the cross-beam 34 so as to prevent movement with respect thereto, by welding, bolts, screws or similar attachment means.

The second end portion 44 of the platform 22 is supported by two legs 32*a,b*. The legs 32*a,b* are securely connected to the end support (such as a 2 inch square metal tube, not shown) extending across the bottom surface 41 of the platform 22. The legs 32*a,b* are preferably attached directly to the end support and/or platform 22 by welding, bolts, screws or similar attachment means.

The third leg 32*c* is attached to the central support extending along the bottom surface 41 of the platform 22 as well. The third leg 32*c* is located between the first and second end portions 42,44 of the platform 22, preferably about 9 inches from the cross-beam 34 towards the second end portion 44 of the platform 22. The third leg 32*c* is to further support of the center of the platform 22 near where the majority of the weight is supported during exercise.

Each leg 32*a,b,c* is made of a strong, durable material such as steel, aluminum or the like. In one embodiment, the legs 32*a,b,c* are made of A-36 steel, and are square and hollow. The outer dimension of each leg 32*a,b,c* is about 1.5–2.5 inches, having a wall thickness of about 3/16 of an inch. The legs 32*a,b,c* can also be constructed of a solid material. However, when the legs 32*a,b,c* are constructed of a solid material, their outer dimension may be enlarged to create the visual appearance of a stronger support structure.

The cross-beam 34 is preferably made of the same material as the legs 32*a,b,c*. When the cross-beam 34 and posts 24*a,b* are made of metal, the cross-beam 34 is welded to the posts 24*a,b*.

The legs 34*a,b,c* and cross-beam 34 described herein comprise the preferred means for supporting the platform 22 in an elevated position above the ground. However, other support means may be used, as well known to those skilled in the art.

Figure 4:
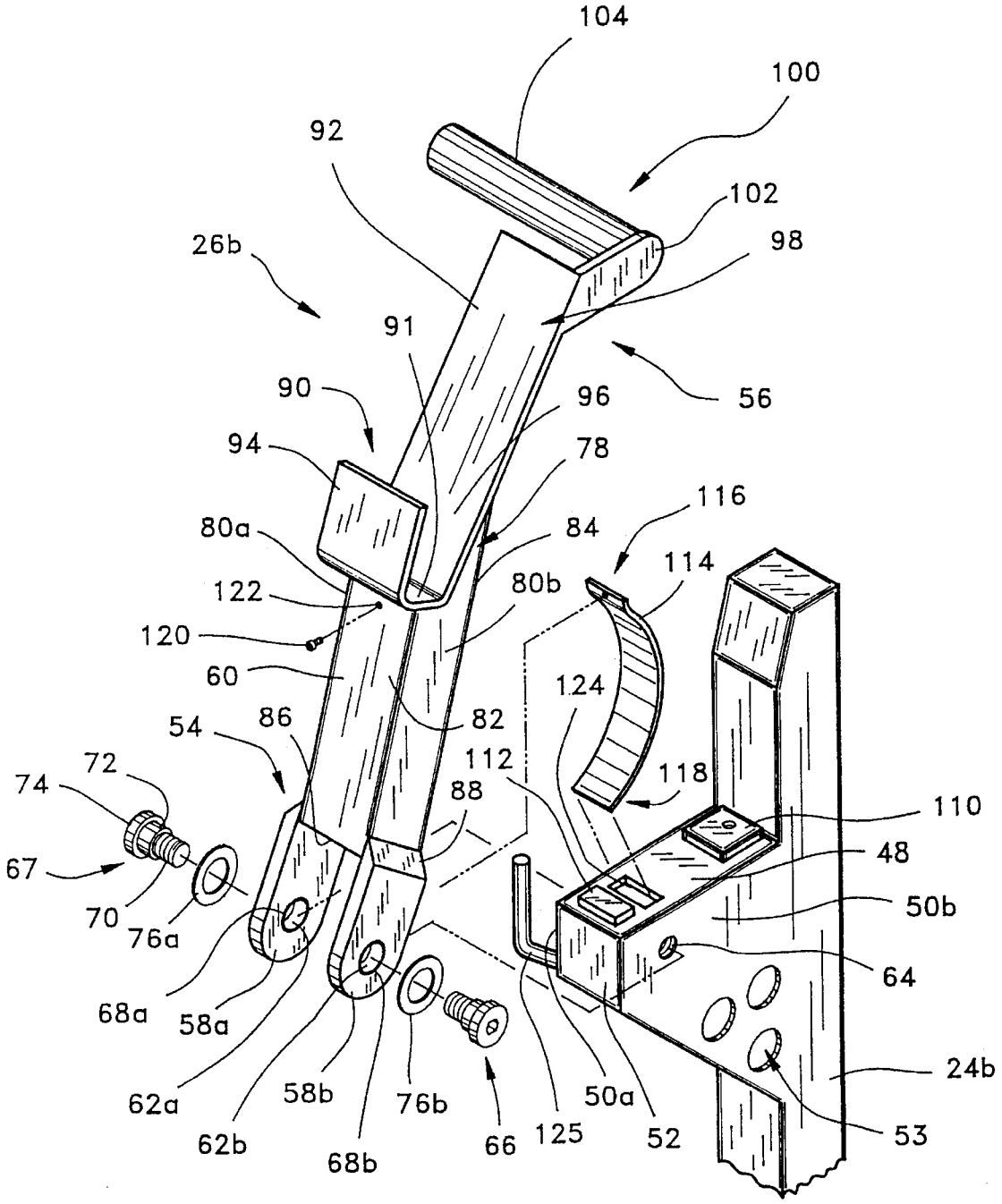
FIG. 4 is an exploded view of the portion of the weight-bar supporting structure illustrated in FIG. 3.

As illustrated in FIG. 1, an outwardly extending shoulder or lug 46*a,b* is located near the second end portion 38 of each post 24*a,b*. A weight-supporting arm 26*a,b* is connected to each of the lugs 46*a,b*. Each lug 46*a,b* is located about 8–12 inches down from the top of the post 24*a,b*, and extends towards the second end portion 44 of the platform 22. As best illustrated in FIG. 4, each lug includes a top surface 48, side surfaces 50*a,b*, and a front end 52.

Each lug 46*a,b* extends outwardly from its corresponding post 24*a,b* about 3–9 inches, and most preferably about 5 inches, towards the second end portion of the platform 22. The top surface 48 of each lug 46*a,b* is preferably parallel to the ground and platform 22.

The top surface 48 is preferably as wide as the post 24*a,b*. The front end 52 is preferably a flat surface approximately 2 inches square. Each side surface 50*a,b* extends downwardly from the top surface 48 along the post 24*a,b* about 3–5 inches, and extends downwardly along the front end 52 about 2 inches so that it is flush therewith. As illustrated, a number of holes 53 may be located in the sides 50*a,b* for ornamentation, and for reducing the overall weight of the structure.

Each lug 46*a,b* can be manufactured in any number of ways. In one method, a flat section of material is bent to form the side 50*a,b* and top surfaces 48. This piece of material is connected to the post 24*a,b*. An end piece is then connected to the first section of material to form the front end.

Preferably, each lug 46*a,b* is made entirely of metal, such as A-36 steel having a thickness of 3/16 of an inch. When formed as described above, the lugs 46*a,b* are constructed by welding the piece or pieces of material to each post 24*a,b*.

In a second method of constructing the lugs 46*a,b*, a 2 inch square pieces of tubular metal is welded to the post 24*a,b*. A section of 2 inch square sheet metal is welded over the open end of the tubular piece of metal to form the front end 52, and sheets of metal are welded onto the tubular piece and posts to form the side surfaces 50*a,b*.

Figure 3:
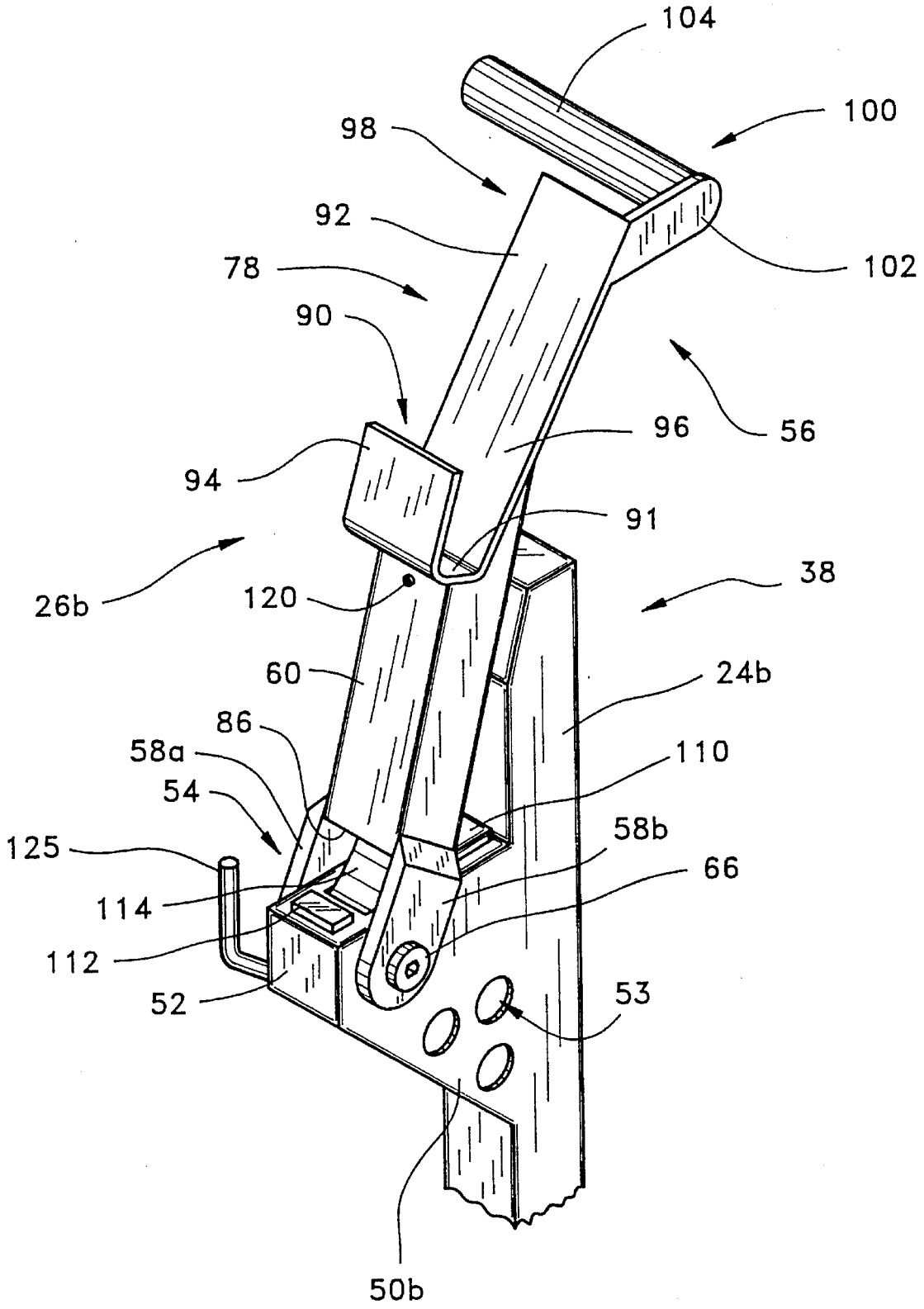
FIG. 3 is a enlarged perspective front view of a portion of the weight-bar supporting structure of FIG. 1 illustrating a portion of a post and an arm connected thereto.
Figure 5:
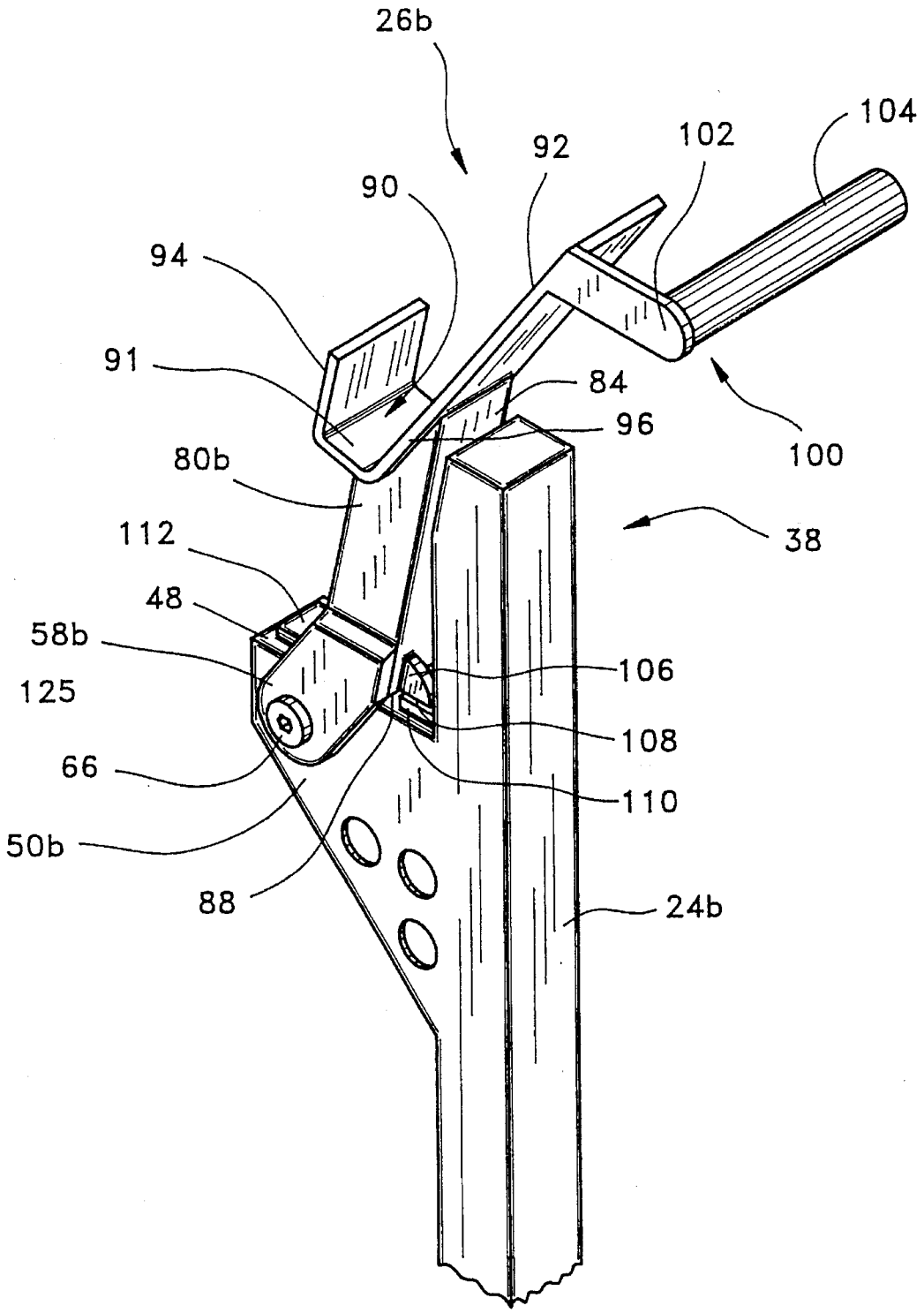
FIG. 5 is an enlarged perspective rear view of the same portion of the weight-bar structure illustrated in FIG. 3.

Weight-bar support means, preferably in the form of arms 26*a,b*, are connected to the support structure 20. Preferably, an arm 26*a,b* is connected to each of the lugs 46*a,b* and includes rotational means for allowing the arm 26*a,b* to move with respect to the lug. Because each of the arms 26*a,b*, and their connection to the lugs 46*a,b*, are preferably identical, the following description, while only for one of the arms 26*b* as best illustrated in FIGS. 3–5, applies to each of them in the same manner.

The arm 26*b* has a first end portion 54 and second end portion 56. The first end portion 54 is connected to the lug 46*b*. The first end portion 54 preferably includes spaced downwardly extending flanges 58*a,b* which straddle the lug 46*b*, one flange 58*a* located over one side surface 50*a* of the lug and the other flange 58*b* located over the other side surface 50*b* of the lug.

Each flange 58*a,b* extends downwardly from a central portion 60 of the arm 26*b*, and includes aligned bores 62*a,b* located therein. The bores 62*a,b* in the flanges 58*a,b* are aligned with a bore 64*b* passing through the lug 46*b*.

Preferably, each flange 58*a,b* is connected to the lug 46*b* with bolts 66,67. The bore 64 in the lug 46*b* is threaded where it passes through the side wall surfaces on each side 50*a,b*. A sleeve 68*a,b* is press-fit into the bore 62*a,b* in each flange 58*a,b*. Bolts 66,67 have a first threaded end portion 70, an intermediate non-threaded portion 72, and a head 74 at a second end and connect the arm 26*b* to the lug 46*b*.

Each bolt 66,67 passes through the flange 58*a,b*, the first end portion 70 engaging the threads in the bore 64 in the lug 46*b*. When in this position, the sleeve 68*a,b* in each flange 58*a,b* engages the intermediate non-threaded portion 72 of the bolt, with the head 74 located outside of the flange. Preferably, a washer 76*a,b* is located between the head 74 and the outer surface of each flange 58*a,b*, as illustrated in FIG. 4.

In the preferred construction of the lugs 46*a,b* described above, the wall thickness of the side portions is approximately about 3/8 of an inch. In order to increase the effective threaded engagement area of each lug 46*a,b* with the bolt 66, a nut (not shown) is connected to the inside surface of each side 50*a,b* of the lug, the nut having a thickness of about 0.25 to 0.75 inches. When a nut is used, it is welded or attached to the side walls of the lug such that they do not protrude from the outwardly facing surface thereof.

As illustrated in FIG. 3, the central portion 60 of the arm 26*b* extends between the flanges 58*a,b* at the first end portion 54 thereof, and a weight-bar support member 78 located at the second end portion 56. The central portion 60 is preferably constructed from 2 inch by 2 inch metal tubing having a square cross-section. Tubing of A-36 steel having a wall thickness of about 3/16 of an inch has been found acceptable.

When in this form, the central portion 60 of the arm 26*b* has two outwardly facing side surfaces 80*a,b*, a front surface 82, and rear surface 84. The flanges. 58*a,b* are preferably formed as extensions of the side surfaces 80*a,b*. The flanges 58*a,b* and central portion 60 can be formed from a single piece of material, but also by the addition of the flanges by welding or the like, to the material which constitutes the central portion.

Because the flanges 58*a,b* extend downwardly from each side 80*a,b* of the central portion 60, edges 86,88 are formed at the bottom of the support on the front 82 and rear 84 sides, respectively.

When having the form described above, the lengthwise dimension of the central portion 60 of each arm 26*a,b* is about 5–12 inches, and most preferably about 8.5 inches. Each flange 58*a,b*, when having a "U"-shape as illustrated, has a radius of about 1–2 inches, and most preferably about 1.5 inches. The bores 62*a,b* in each flange 58*a,b* have a diameter of about 0.5 inches, for accommodating bolts 66,67 having approximately the same diameter non-threaded portion 72.

The weight-bar support member 78 is preferably "J"-shaped, having a bar cradle portion 90 and an upwardly extending bar guide means 92. Preferably, the member 78 is formed from a single piece of material connected to and supported by the central portion 60.

The cradle 90 is the bottom of the "J"-shaped section of the member 78 which is attached to the central portion 60. A first stem 94 of the "J" is located slightly outwardly of the front side 82 of the central portion 60 and extends upwardly about 1–2 inches, and most preferably about 2 inches. The cradle 90 itself has a substantially flat bottom surface 91, separating the first stem 94 from a second stem 96 by about 1.5 inches. The second stem 96 extends upwardly from the flat bottom 91 into the top guide means 92 portion of the "J". The cradle 90 is preferably constructed of metal, and has a width from 1–5 inches, and preferably about 3 inches.

The width of the flat bottom 91 of the cradle 90 is greater than the diameter of a bar, allowing a bar placed therein to rest directly on the bottom. The upwardly extending first stem 94 prevents the bar from bouncing, rolling or falling from the cradle 90.

The guide means 92 slopes upwardly and backwardly from the second stem 96. From the bottom of the cradle 90 to a top end 98 of the weight-bar support 78, the distance is preferably about 5–10 inches, and most preferably about 7–8 inches. The width of the guide means or 92 is about the same as the width of the cradle 90.

As stated above, the guide 92 slopes rearwardly from bottom to top, as compared to the front and rear sides 82,84 of the central portion 60. Preferably, the bottom of the cradle 90 is located approximately over the front side 82 of the central portion 60, and the top of the guide 92 is located rearwardly of the rear side 84 of the main support portion by several inches. Thus, the guide 92 is offset at an angle of about 10–40 degrees, preferably about 30 degrees, to the arm **26*b***.

A handle 100 extends from the top end 98 of the support 78. The handle 100 includes a mounting flange 102 extending rearwardly from the guide 92, and a cylindrical grip 104. The flange 102 is a thin piece of material welded to an outside edge of the guide 92. The grip 104 is preferably a tubular member which extends inwardly from the flange 102. The grip 104 has a diameter of about 1 inch, and has a length of about 5–15 inches, and most preferably about 8–10 inches. Foam, rubber, or other material may be located over the grip 104 when it is made of metal to make the grip user friendly.

A stop 106 is located on the rear side 84 of the central portion 60 for limiting the rearward travel of the arm **26*b* with respect to the lug 46*b*. The stop 106 extends outwardly from the central portion 60 about 1 inch, and includes a flat lower surface 108. This surface 108 is approximately even with the bottom edge 88 of the central portion 60 at the rear side 84** thereof.

The stop 106 engages a cushion 110 located on the top surface 48 of the lug **46*b*. As illustrated, the cushion 110 is a small block of durable, but slightly flexible, energy absorbing material securely connected to the lug 46*b* near the post 24*b*. Neoprene has been found to be an especially good cushion material. The cushion 110 is about 1 inch long and 2 inches wide, and is attached to the lug 46*a,b*** via offset screw, adhesive or other attachment means well known in the art.

A similar cushion 112 is located near the front end 52 of the lug **46*b* on the top surface 48. This cushion 112 preferably comprises a similar material, and is about 2–2.5 inches in width and about 0.5 inches in depth. The cushion 112 is located on the lug 46*b* in a position for engaging the front edge 82 of the central portion 60 of the arm 26*b***.

As can be seen in FIGS. 1 and 3, the second end portion 38 of each post **24*b* preferably extends slightly upwardly beyond the lug 46*b* which supports the arm 26*b*. The posts 24*b* extend about 1–5 inches beyond the top surface 48 of the lug 46*b***.

Most importantly, to accommodate the backward tilting guide means 92 located on the arm **26*b*, and to prevent it from hitting the post 24*b* or having a user's fingers become trapped therebetween, the front side of the post in this area slopes backwardly. The exact slope depends on the slope of the guide 92 and the height of the post 24*b*, but in any case should leave 0.5–3 inches of space between the post 24*b* and the arm 26*b*** when each arm is closest to the post.

Figure 2:
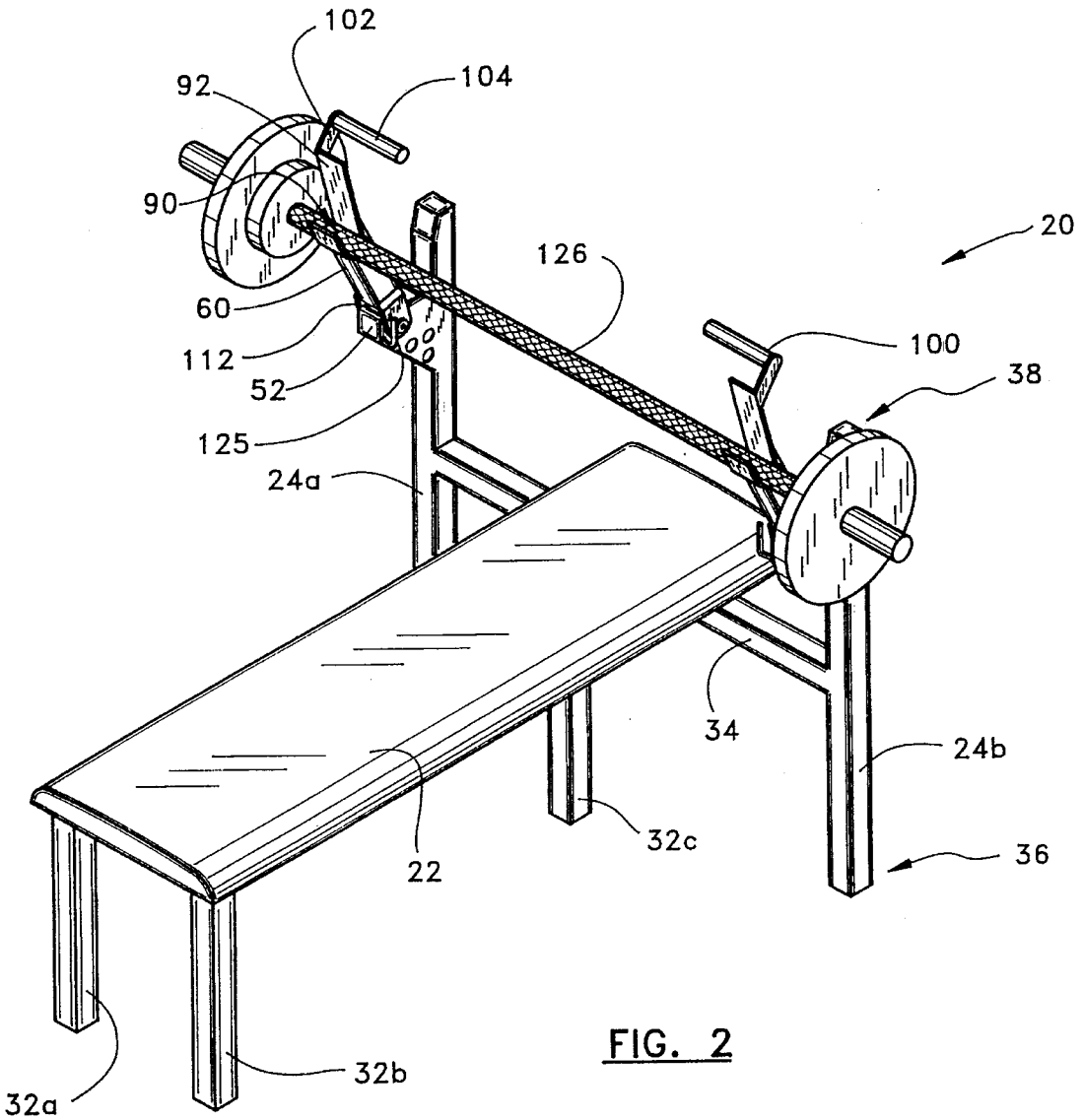
FIG. 2 is a perspective view of the weight-bar supporting structure of FIG. 1 illustrated with the arms thereof in a lift-off position.

The above-described arm/lug combination allows each arm **26*a,b* to move from a first retracted position, to a second lift-off position, as illustrated in FIGS. 1 and 2. The arms 26*a,b* are in their retracted position when the stop 106 located on the rear surface 84 of the central portion 60 of the arm is in contact with the cushion 110 on the lug, as illustrated in FIGS. 1 and 5. In the lift-off position, the arms 26*a,b* extend away from the posts 24*a,b*, with the leading edge 86 of the central portion 60 of each arm 26*a,b* engaging the cushion 112 near the front end of the lug 46*a,b*, as illustrated in FIG. 2. Rotational attachment of the arms 26*a,b* to the lugs 46*a,b* via the bolts 66,67** allows for movement of the arms between these two positions.

Preferably, return or biasing means are provided for automatically moving the arms **26*a,b* from the lift-off position back to their retracted position. In the preferred embodiment, the return means comprises a spring 114, as illustrated in FIG. 4**.

The spring 114 is an elongate body, preferably constructed of metal, which is curved to create a biasing force from a first end portion 116 to a second end portion 118. The spring 114 is approximately 6–8 inches, and most preferably about 7.5 inches long, and 1–2 inches wide. The maximum depth in curvature with respect to the ends 116,118 depends on the desired spring force, but is preferably around 1 inch.

The first end portion 116 is connected to the inside of the arm **26*a,b* within the hollow interior of the central portion 60. An Allen screw 120 passes through the front side 82 of the main support portion just below the cradle 90 and engages a threaded hole 122 in the first end portion 116 in the spring 114**.

The second end portion 118 of the spring 114 passes through a slot 124 located in the top surface 48 of the lug **46*a,b*. The slot 124 is located rear of the front end 52 of the lug 46*a,b* by about 1.5 inches, and is about 0.5 inches in length (front to rear) and 2–2.5 inches wide (side to side). Because the first end portion 116 of the spring 114 is securely connected to the arm 26*a,b*, no direct attachment means are used to locate the second end portion 118 of the spring 114 in the slot 124**.

An upwardly extending catch, in the form of a pin 125, is located on each lug **46*a,b*, for use in stationing a bar on the lugs 46*a,b* in case of emergency, as described below. The pin 125 is somewhat "L"-shaped, having a first end connected to the inside surface 50*a* of the lug 46*b*, and a second free end located vertically above the top surface 48** of the lug.

Use of the weight-bar support structure 20 described above is as follows.

An exerciser locates a weight-bar 126, with or without additional weights thereon, on the structure 20. The user places the bar 126 in horizontal fashion within the cradles 90 located on each arm **26*a,b* with each arm in retracted position as illustrated in FIG. 1. In this position, the bar 126 is supported towards the outer ends thereof by the spaced cradles 90**.

Next, the user lays on his back on the platform 22, with his head under the bar 126 between the two posts **24*a,b*. The user or a spotter then moves the arms 26*a,b*, and thus the bar 126, into the lift-off position. The user moves the bar into lift-off position by pulling slightly on any portion of the bar 126 or either arm 26*a,b*, pulling the arms 26*a,b* and bar 126 forward. A spotter can move the bar into lift-off position for a user by grasping the handles 100** and pushing them forwards.

In either instance, the weight of the bar 126 and arms **26*a,b*, along with any pulling or pushing force, rotate them to the lift-off position against the force provided by spring 114. Rotation of the arm 26***a,b* stops when the front edge 86 of the central portion 60 of each arm contacts the cushion 112 near the front end 52 of the lug. At all times, however, the load on each arm 26*a,b* is born by the lugs 46*a,b* through the bolts 66,67. The cradle 90 prevents the bar 126 from sliding, bouncing or rolling from the cradle 90 when the arms 26*a,b* are moved to the lift-off position, without regard to how quickly the arms are moved to this position.

The weight of the bar 126 maintains the arms 26*a,b* and the bar 126 in the lift-off position, overcoming the force of the spring 114. At this time, the bar 126 is conveniently located directly over the chest of the exerciser. The exerciser reaches up, grasps the bar 126, and presses it upwardly out of the cradles 90.

As the user removes the bar 126 from the cradles 90 on the arms 26*a,b*, the reduced weight biasing force is overcome by the spring 114, causing each arm 26*a,b* to begin moving back towards the retracted position. Once the user has completely lifted the bar 126 from the arms 26*a,b*, the arms are immediately returned by the spring 114 back to the retracted position. Movement of the arms 26*a,b* to the retracted position is stopped when the stop 106 on the arm 26*a,b* encounters cushion 110 on the lug 46*a,b*.

After the user has completed the exercise, he returns the bar 126 back to the cradles on the arms of the support structure 20. The user maintains the bar 126 pressed upwardly above him, and then moves the bar backwardly until it hits the guide 92 on each arm 26*a,b*. The guide 92 prevents further rearward movement of the bar 126, and aids the user in guiding the bar 126 into the cradles 90.

Most importantly, the ability of the exerciser to move the bar from a supported stationary position to a position in which it is ready for use reduces the injuries caused when the exerciser begins the exercise.

Preferably, a spotter is present during all phases of exercise. The present mechanism reduces risks of injury to the spotter when the bar is moved from the retracted to the lift-off position. In particular, as stated above, the spotter no longer needs to actually lift any weight and transfer it to the user. Instead, the user or the spotter simply moves the arms with the weights thereon into a position where the bar is lifted by only the user.

If, when a user has completed exercising, he is unable to press the bar 126 upwardly far enough to reach the height of the cradles 90, he can simply set the bar on the lugs 46*a,b*. The user presses the bar 126 slightly upwards and sets the bar 126 on the top surfaces 48 of the lugs 46*a,b*. The pin 125 which extends upwardly just beyond the top surface 48 prevents the bar 126 from rolling off of the lugs onto the user.

The ability of the user to set the bar 126 on the lugs 46*a,b* in case of emergency benefits not only the user, but any spotter who might be aiding the user. In particular, if the user needs assistance in moving the bar 126 at all, the spotter need only lift the bar 126 a short distance to get it in the safety position. Because this position is much lower than the cradles 90, the spotter can use his stronger leg muscles to effectuate the upward movement of the bar 126, as opposed to weaker shoulder, lower back, and arm muscles.

In accordance with the present invention, numerous variations of the elements described above are possible for accomplishing the present invention.

For example, the platform 22 which supports the exerciser need not be directly connected to the support structure 20. The support structure 20 of the present invention may simply comprise the posts 24*a,b*, with the lugs and arms connected thereto. In this form, the structure should include means for supporting the posts in stationary fashion, such as by anchoring the posts in concrete, bolting them to the floor, or providing additional stabilizing elements. A separate user supporting platform is then used in conjunction with the weight-bar support structure.

While the arms are described above as moving from the retracted to the lift-off position in rotatable fashion, the arm might be connected to the structure and move between these positions in a combination of translating and rotating, or solely translating movement.

Further, while the structure 20 described above has two arms 26*a,b*, it is possible that a single arm be used to support the weight-bar. In particular, a single arm which is moveable between a retracted and lift-off position and which includes a widened bar supporting portion may be used to support the bar. Alternatively, three or more arms may be provided for supporting the bar.

Also, the return means for moving the arms 26*a,b* from the lift-off to the retracted position may include a helical spring, hydraulic or air actuated piston, electrically operated motor means, or other means for effectuating movement known in the art.

As a further aspect of the present invention, the above-described weight-bar support can be adapted to several other structures. For example, the same structure as described above can be used in conjunction with a "decline" or "incline" bench press. In these configurations, the user supporting platform 22 simply either tilts or slants up or down from first end portion to second end portion.

Further, the structure is useful with a "military" press exercise. In this exercise, the weight-bar is normally supported higher from the user supporting platform than in the bench press. However, the same weight-bar supporting arms are preferably used to support the bar, and move the bar from retracted to lift-off back to retracted position.

It will be understood that the above described arrangements of apparatus and the method therefrom are merely illustrative of applications of the principles of this invention and many other embodiments and modifications may be made without departing from the spirit and scope of the invention as defined in the claims.

I claim:

1. A bench-press exercise apparatus in which a user reclines on a platform facing upwardly, grasps a weight-bar with both hands and repeatedly moves his arms between a lowered position in which the bar is immediately above his chest and an elevated position, said apparatus comprising:

a support structure;

a generally horizontal, elongate, user-supporting platform extending outwardly from the support structure;

first and second arms positioned near a head end of the platform on opposing sides of the platform each pivotally mounted at a lower portion of said arm to the support structure, the upper portion of each of said arms being movable in a vertical plane between a raised retracted position above the head end of the platform and a lower light-off position more toward the opposite end of the platform;

first and second cradle means for retaining the weight-bar in a generally horizontal position above the platform mounted at an upper portion of the first and second arms, respectively; and return means for automatically moving said arms from said lift-off position to said retracted position when a weight-bar is removed from said arms in said lift-off position whereby a user may recline on the platform and remove a weight bar from the cradle means in the lift-off position above the user's chest, whereupon the cradle means will be moved to the retracted position above the user's head by the return means.

2. The exercise apparatus of claim 1, wherein said support structure includes a cross-member extending beneath said platform and at least one leg.

3. The exercise apparatus of claim 1, wherein said support structure includes a pair of upwardly extending posts and each of said arms have a first end portion connected to a lug extending outwardly from said posts, respectively.

4. The exercise apparatus of claim 3, where the first end portion of each arm includes two downwardly extending flanges.

5. The excercise apparatus of claim 3, wherein said first end portion of each arm includes a downwardly extending flanges located on first and second sides of said lugs.

6. The excercise apparatus of claim 3, wherein said first end portion of each arm is connected to said lug with at least one pin.

7. The excercise apparatus of claim 6, wherein a first pin passes through a first sides of said arm into said lug, and a second pin passes through a second side of said arm into said lug.

8. The excercise apparatus of claim 7, wherein said pins include a smooth portion for engaging a sleeve located in each side of said arm.

9. The exercise apparatus of claim 1, wherein said cradle means is a U-shaped cradle.

10. The excercise apparatus of claim 1, further including a weight-bar guide.

11. The exercise apparatus of claim 10, wherein said guide comprises a member extending upwardly and sloping away from aid cradle means located on each of said arms.

12. The excercise apparatus of claim 1, further including a user engaging handle connected to said arm.

13. The excercise apparatus of claim 1, wherein said return means comprises a spring.

14. The excercise apparatus of claim 13, wherein said spring has a first end portion connected to said arm and a second end portion connected to said post.

15. The excercise apparatus of claim 14, wherein said second end portion of said spring engages a slot located in a lug located on said post.

16. The excercise apparatus of claim 14, wherein said first end portion of said spring is located in a hollow portion of said arm.

17. The excercise apparatus of claim 1, further including stop means for limiting the movement of said arm.

18. A weight-bar supporting structure for use with a weight bench platform comprising:

a support structure including first and second upwardly extending posts; first and second arms rotatably connected respectively to the first and second posts for movement in a vertical plane, the upper end portions of each of said arms movable between a first retracted position proximate the post to a second weight-bar lift-off position;

first and second cradle means for supporting a weight-bar in an elevated, generally horizontal position mounted at the upper end portions of the first and second arms, respectively;

guide means extending upwardly from the cradle means for automatically directing the weight-bar into the cradle means; and return means for moving said arms from said lift-off position whereby a user may recline on a weight bench platform between the posts and remove a weight bar from the cradle means in the lift-off position above the user's chest, whereupon the cradle means will be moved to the retracted position above the user's head by the return means to said retracted position when a weight-bar is removed from said arms in said lift-off position.

19. The structure of claim 18, wherein said arm is connected to a lug located on said post.

20. The structure of claim 19, further including a pin extending from said lug for stopping said bar from falling from said lug when located thereon.

21. The structure of claim 18, wherein said arm is connected to said post with at least one pin.

22. The structure of claim 18, wherein said arm is a rotatably connected to said post at a lower portion of the post.

23. The structure of claim 18, wherein said cradle means is U-shaped weight-bar supporting cradle.

24. The structure of claim 23, wherein said guide means comprises a member sloping upwardly and away from said cradle.

25. The support structure of claim 18, wherein said return means comprises a spring.

26. The support structure of claim 25, wherein said spring has a first end portion connected to said arm and a second end portion connected to said post.

27. The support structure of claim 26, wherein said second end portion of said spring engages a slot located in a lug located on said post.

28. The support structure of claim 26, wherein said first end portion of said spring is located in a hollow portion of said arm.

29. The support structure of claim 18, further including a stop located on said arm for limiting the travel of said arm at said retracted position with respect to said post.

30. An apparatus for delivery of a weight-bar to a user for performing a weight-lifting exercise, comprising:

a frame;

a user-supporting platform connected to the frame, the platform having a head end and an opposite end;

weight-bar receiving means including at least one arm mounted at a lower portion thereof to the frame, the upper portion of the arm movable in a vertical plane for supporting a weight-bar in a horizontal position above the ground, said receiving means being movable on the frame between a raised retracted position and a lowered lift-off position more towards the opposite end of the platform;

cradle means mounted at an upper portion of the arm for retaining a weight bar in a generally horizontal position;

guide means for directing the weight-bar into the cradle means; and biasing means urging the eight-bar receiving means toward the retracted position for automatically returning the weight-bar to the retracted position when the weight-bar is removed therefrom in the lift-off position.

31. The apparatus of claim 30, further guide means for directing a weight-bar into the cradle means.

32. The apparatus of claim 30, wherein said biasing means comprises a spring.

33. The apparatus of claim 30, further including stop means for limiting the travel of said receiving means at said retracted and lift-off positions.

* * * * *